US007097720B2

(12) United States Patent
Mannava et al.

(10) Patent No.: US 7,097,720 B2
(45) Date of Patent: Aug. 29, 2006

(54) LOWER FLUENCE BOUNDARY LASER SHOCK PEENING

(75) Inventors: Seetha Ramaiah Mannava, Cincinnati, OH (US); Todd Jay Rockstroh, Maineville, OH (US); William Woodrow Shepherd, West Chester, OH (US); Ian Francis Prentice, Cincinnati, OH (US); Thomas Froats Broderick, Springboro, OH (US)

(73) Assignee: General Electric Company, Schenectady, NY (US)

( * ) Notice: Subject to any disclaimer, the term of this patent is extended or adjusted under 35 U.S.C. 154(b) by 454 days.

(21) Appl. No.: 10/426,816

(22) Filed: Apr. 30, 2003

(65) Prior Publication Data

US 2004/0217094 A1 Nov. 4, 2004

(51) Int. Cl.
*C21D 1/04* (2006.01)
*C21D 1/09* (2006.01)
*C21D 1/10* (2006.01)

(52) U.S. Cl. ..... 148/565; 219/121.6; 219/121.61; 219/121.85; 416/241 R

(58) Field of Classification Search ..... None
See application file for complete search history.

(56) References Cited

U.S. PATENT DOCUMENTS 5,911,891 A * 6/1999 Dulaney et al. ..... 219/121.85
5,932,120 A 8/1999 Mannava et al.
6,197,133 B1 3/2001 Unternahrer et al.
6,410,884 B1 6/2002 Hackel et al.
6,415,486 B1 7/2002 Prevey, III
6,500,269 B1 12/2002 Risbeck et al.
6,517,319 B1 * 2/2003 Webster et al. ..... 416/241 R
6,541,733 B1 4/2003 Mannava et al.
6,759,626 B1 * 7/2004 Clauer et al. ..... 219/121.6
2003/0024904 A1 2/2003 Clauer et al.
2003/0024915 A1 2/2003 Clauer et al.
2003/0026700 A1 2/2003 Clauer et al.
2003/0042234 A1 3/2003 Suh et al.
2003/0062350 A1 4/2003 Staver et al.

FOREIGN PATENT DOCUMENTS

WO WO 95/25821 9/1995
WO WO 01/05549 1/2001

OTHER PUBLICATIONS

European Search Report w/ Annex, Sep. 22, 2004, 3 pages.
XP-002290703, Database Inspec Online!, Institute Of Electrical Engineers, Stevenage, GB, Oct. 18, 2001, 1 page.

* cited by examiner

*Primary Examiner*—John P. Sheehan
(74) *Attorney, Agent, or Firm*—William Scott Andes; Steven J. Rosen

(57) ABSTRACT

A method for laser shock peening an article including laser shock peening a first area with at least one high fluence laser beam and laser shock peening a border area between the first area and a non-laser shock peened area of the article with at least one first low fluence laser beam. The border area may be laser shock peened with a second low fluence laser beam or more low fluence laser beams wherein the second low fluence laser beam and others have a lower fluence than the first low fluence laser beam. The border area may be laser shock peened with progressively lower fluence laser beams starting with the one first fluence laser beam wherein the progressively lower fluence laser beams are in order of greatest fluence to least fluence in a direction outwardly from the first area through the border area to the non-laser shock peened area.

12 Claims, 4 Drawing Sheets

LOWER FLUENCE BOUNDARY LASER SHOCK PEENING

BACKGROUND OF THE INVENTION

1. Field of the Invention

This invention relates to laser shock peening and, more particularly, to methods and articles of manufacture employing laser shock peening a boundary area bordering a laser shock peened surface with a lower fluence.

2. Description of Related Art

Laser shock peening or laser shock processing, as it is also referred to, is a process for producing a region of deep compressive residual stresses imparted by laser shock peening a surface area of an article. Laser shock peening typically uses one or more radiation pulses from high energy, about 50 joules or more, pulsed laser beams to produce an intense shockwave at the surface of an article similar to methods disclosed in U.S. Pat. No. 3,850,698 entitled "Altering Material Properties"; U.S. Pat. No. 4,401,477 entitled "Laser Shock Processing"; and U.S. Pat. No. 5,131,957 entitled "Material Properties". The use of low energy laser beams is disclosed in U.S. Pat. No. 5,932,120, entitled "Laser Shock Peening Using Low Energy Laser", which issued Aug. 3, 1999 and is assigned to the present assignee of this patent. Laser shock peening, as understood in the art and as used herein, means utilizing a pulsed laser beam from a laser beam source to produce a strong localized compressive force on a portion of a surface by producing an explosive force at the impingement point of the laser beam by an instantaneous ablation or vaporization of a thin layer of that surface or of a coating (such as tape or paint) on that surface which forms a plasma.

Laser shock peening is being developed for many applications in the gas turbine engine field, some of which are disclosed in the following U.S. Pat. No. 5,756,965 entitled "On The Fly Laser Shock Peening"; U.S. Pat. No. 5,591,009 entitled "Laser shock peened gas turbine engine fan blade edges"; U.S. Pat. No. 5,531,570 entitled "Distortion control for laser shock peened gas turbine engine compressor blade edges"; U.S. Pat. No. 5,492,447 entitled "Laser shock peened rotor components for turbomachinery"; U.S. Pat. No. 5,674,329 entitled "Adhesive tape covered laser shock peening"; and U.S. Pat. No. 5,674,328 entitled "Dry tape covered laser shock peening", all of which are assigned to the present Assignee.

Laser peening has been utilized to create a compressively stressed protective layer at the outer surface of an article which is known to considerably increase the resistance of the article to fatigue failure as disclosed in U.S. Pat. No. 4,937,421 entitled "Laser Peening System and Method". These methods typically employ a curtain of water flowed over the article or some other method to provide a plasma confining medium. This medium enables the plasma to rapidly achieve shockwave pressures that produce the plastic deformation and associated residual stress patterns that constitute the LSP effect. The curtain of water provides a confining medium, to confine and redirect the process generated shockwaves into the bulk of the material of a component being LSP'D, to create the beneficial compressive residual stresses.

The pressure pulse from the rapidly expanding plasma imparts a traveling shockwave into the component. This compressive shockwave caused by the laser pulse results in deep plastic compressive strains in the component. These plastic strains produce residual stresses consistent with the dynamic modules of the material. The many useful benefits of laser shock peened residual compressive stresses in engineered components have been well documented and patented, including the improvement on fatigue capability. These compressive residual stresses are balanced by the residual tensile stresses in the component. These added residual tensile stresses may lower fatigue capability of components and, thus, should be reduced and/or minimized. The laser shock peening is performed at selective locations on the component to solve a specific problem. The balancing tensile stresses usually occur at the edge of the laser shock peened area. Small narrow bands or lines of tensile stresses can build up immediately next to the laser shock peened patch or area along the edges of the patch. Extensive finite element analyses are done to determine where these tensiles will reside and the LSP patches are designed and dimensioned such the tensile band(s) end up in an inert portion of the article or component (e.g. not at a high stress line in one of the flex, twist or other vibratory modes). It is desirable to reduce the level of these tensile stresses in the transition area between the laser shock peened and non-laser shock peened areas.

SUMMARY OF THE INVENTION

A method for laser shock peening an article including laser shock peening a first area with at least one high fluence laser beam and laser shock peening a border area between the first area and a non-laser shock peened area of the article with at least one first low fluence laser beam. In one particular embodiment of the method, the first low fluence laser beam has a fluence of about 50% of the high fluence laser beam and the high fluence laser beam may have, for example, a fluence of about 200 J/cm$^2$. In another more particular embodiment of the method, the first low fluence laser beam is used to form only a single row of first low fluence laser shock peened spots in the border area.

Another embodiment of the method further includes laser shock peening a first portion of the border area bordering the first area with the first low fluence laser beam laser and laser shock peening a second portion of the border area between the first area and the non-laser shock peened area with a second low fluence laser beam wherein the second low fluence laser beam has a lower fluence than the first low fluence laser beam. In a more particular embodiment of the method, the first low fluence laser beam has a fluence of about 50% of the high fluence laser beam. The second low fluence laser beam may have a fluence of about 50% of the first low fluence laser beam. The high fluence laser beam may have a fluence of about 200 J/cm$^2$ in another more particular embodiment.

Another embodiment of the method further includes laser shock peening the border area with progressively lower fluence laser beams starting with the one first fluence laser beam wherein the progressively lower fluence laser beams are in order of greatest fluence to least fluence in a direction outwardly from the first area through the border area to the non-laser shock peened area. A more particular embodiment of the method further includes forming high fluence laser shock peened spots in the first area, forming first low fluence laser shock peened spots in the border area, and operating the high and low fluence laser beams at the same power or energy level wherein the first low fluence laser shock peened spots are larger in area than the high fluence laser shock peened spots.

DETAILED DESCRIPTION OF THE INVENTION

Figure 1:
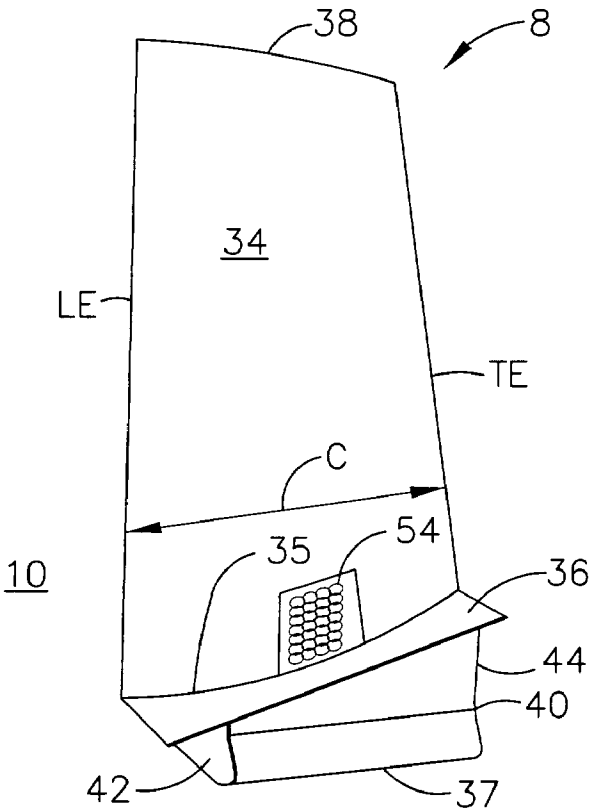
FIG. 1 is a perspective view illustration of a fan blade exemplifying a laser shock peened article laser shock peened with a high fluence laser beam in a first area and a low fluence laser beam in a border area between the first area and a non-laser shock peened area of the article.

Illustrated in FIG. 1 is a fan blade 8 having an airfoil 34 made of a Titanium alloy extending radially outward from a blade platform 36 from a blade base 35 to a blade tip 38. The blade 8 is representative of a hard metallic article 10 for which lower fluence boundary laser shock peening was developed. The fan blade 8 includes a root section 40 extending radially inward from the platform 36 to a radially inward end 37 of the root section 40. At the radially inward end 37 of the root section 40 is a blade root 42 which is connected to the platform 36 by a blade shank 44. The airfoil 34 extends in the chordwise direction between a leading edge LE and a trailing edge TE of the airfoil. A chord C of the airfoil 34 is the line between the leading LE and trailing edge TE at each cross-section of the blade. It is well known to use laser shock peening to counter possible fatigue failure of portions of an article. Typically, one or both sides of the article such as the blade 8 are laser shock peened producing laser shock peened patches or surfaces 54 and pre-stressed regions 56 having deep compressive residual stresses imparted by a laser shock peening (LSP) method extending into the article from the laser shock peened surfaces 54.

Figure 2:
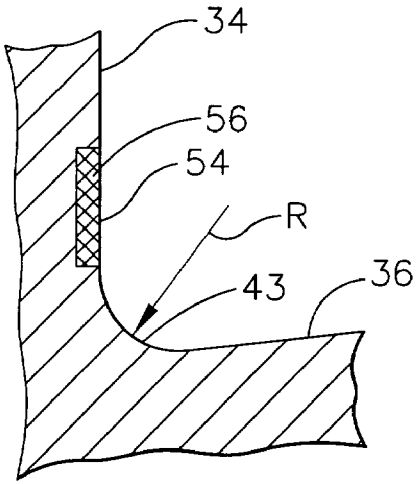
FIG. 2 is a cross-sectional view illustration of laser shock peened area near a fillet between an airfoil and a blade platform of the fan blade illustrated in FIG. 1.

The laser shock peened surfaces 54 illustrated in FIG. 1 is placed about mid-chord on the airfoil 34 along the base 35 and just above the platform 36 of the blade 8. Further referring to FIG. 2, a fillet 43 having a radius R is formed about the base 35 between the airfoil 34 and the platform 36. The laser shock peening imparted compressive residual stresses in the pre-stressed regions 56 are balanced by residual tensile stresses that extend into the fillet 43 and may lower fatigue capability of the blade leading to cracking in the area of the fillet. Lower fluence boundary laser shock peening was developed to reduce these residual tensile stresses and minimize or eliminate lowered fatigue capability due to laser shock peening this area.

Figure 3:
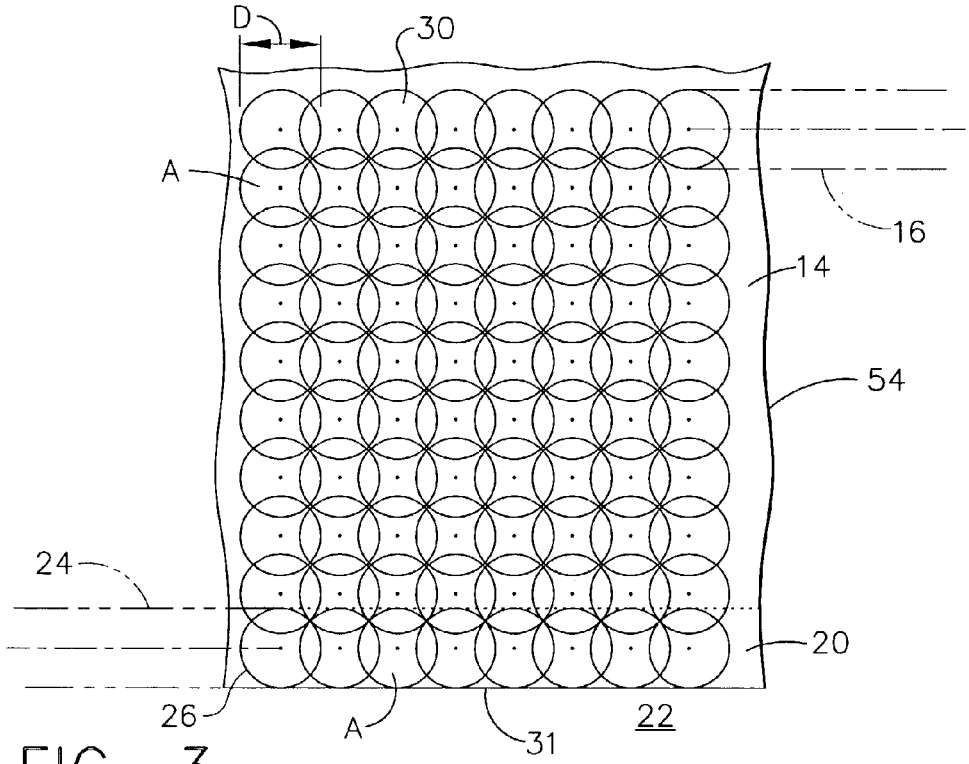
FIG. 3 is an exemplary schematic illustration of a method to laser shock peen the article in FIG. 1, with the high fluence laser beam in a first area and the low fluence laser beam in the border area between the first area and the non-laser shock peened area of the article.

FIG. 3 illustrates a lower fluence boundary laser shock peening method for laser shock peening an article such as the fan blade 8. The method includes laser shock peening a first area 14 with at least one high fluence laser beam 16 and laser shock peening a border area 20 between the first area 14 and a non-laser shock peened area 22 of the article 10 with at least one first low fluence laser beam 24. In one particular embodiment of the method, the first low fluence laser beam 24 has a fluence of about 50% of the high fluence laser beam 16. One particularly useful fluence of the high fluence laser beam 16 is about 200 J/cm$^2$.

High fluence laser shock peened spots 30 formed in the first area 14 and first low fluence laser shock peened spots 31 formed in the border area 20 are illustrated in FIG. 3 as having the same diameter D and spot area A indicating that the high fluence laser beam 16 and the first low fluence laser beam 24 have the same laser beam cross-sectional area and diameter but different fluences and, thus, are from laser beams of different powers or energy levels. The method is designed to use either high energy laser beams, from about 20 to about 50 joules, or a low energy laser beams, from about 3 to about 10 joules, as well as other levels. See, for example, U.S. Pat. No. 5,674,329 (Mannava et al.), issued Oct. 7, 1997 (LSP process using high energy lasers) and U.S. Pat. No. 5,932,120 (Mannava et al.), issued Aug. 3, 1999 (LSP process using low energy lasers). The combination of the energy of the laser and the size of the laser beam provides an energy density or fluence that is usually up to about 200 J/cm$^2$ for the high fluence laser beam 16 though somewhat lower fluences may be used. The laser shock peened spots and laser beams are illustrated as circular in shape but may have other shapes such as oval or elliptical (see U.S. Pat. No. 6,541,733, entitled "Laser Shock Peening Integrally Bladed Rotor Blade Edges" by Mannava, et al., issued Apr. 1, 2003. The laser shock peened spots are typically formed in overlapping rows of overlapping spots. Overlaps of about 30% of diameters between both spots in a row and between spots in adjacent rows is one particular design.

Figure 4:
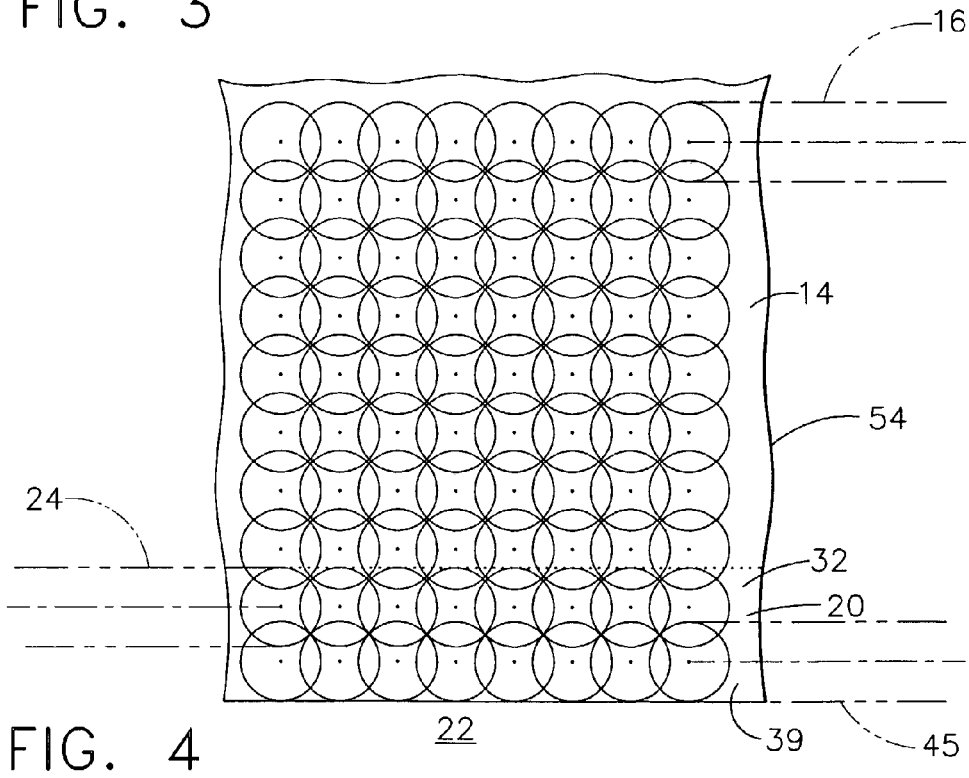
FIG. 4 is a diagrammatic illustration of a laser shock peening method using two rows of progressively lower fluence laser shock peened spots in the border area illustrated in FIG. 3.
Figure 5:
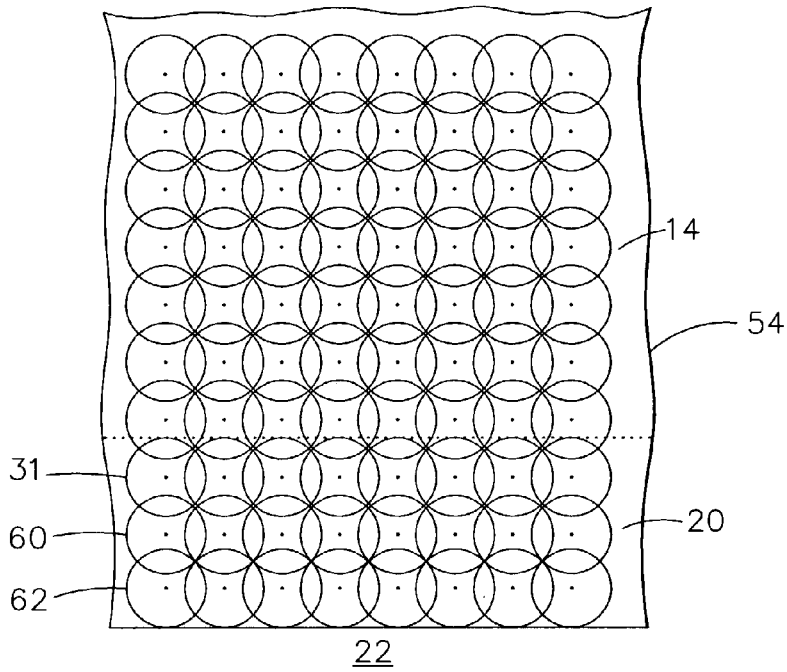
FIG. 5 is a diagrammatic illustration of a laser shock peening method using three rows of progressively lower fluence laser shock peened spots in the border area illustrated in FIG. 3.

In the embodiment of the method illustrated in FIG. 3, the first low fluence laser beam 24 is used to produce only a single row 26 of first low fluence laser shock peened spots 31 in the border area 20. Another embodiment of the method illustrated in FIG. 4 further includes laser shock peening a first portion 32 of the border area 20 bordering the first area 14 with the first low fluence laser beam laser 24 and laser shock peening a second portion 39 of the border area 20 between the first area 14 and the non-laser shock peened area 22 with a second low fluence laser beam 45 wherein the second low fluence laser beam 45 has a lower fluence than the first low fluence laser beam 24. In a more particular embodiment of the method, the first low fluence laser beam 24 has a fluence of about 50% of the high fluence laser beam 16. The second low fluence laser beam 45 may have a fluence of about 50% of the first low fluence laser beam 24. A particularly useful fluence of the high fluence laser beam 16 is about 200 J/cm$^2$. Other numbers of low fluence laser beams may be used such as three indicated by first, second, and third rows of first, second, and third low fluence laser shock peened spots 31, 60, and 62, respectively, in the border area 20 illustrated in FIG. 5.

Figure 6:
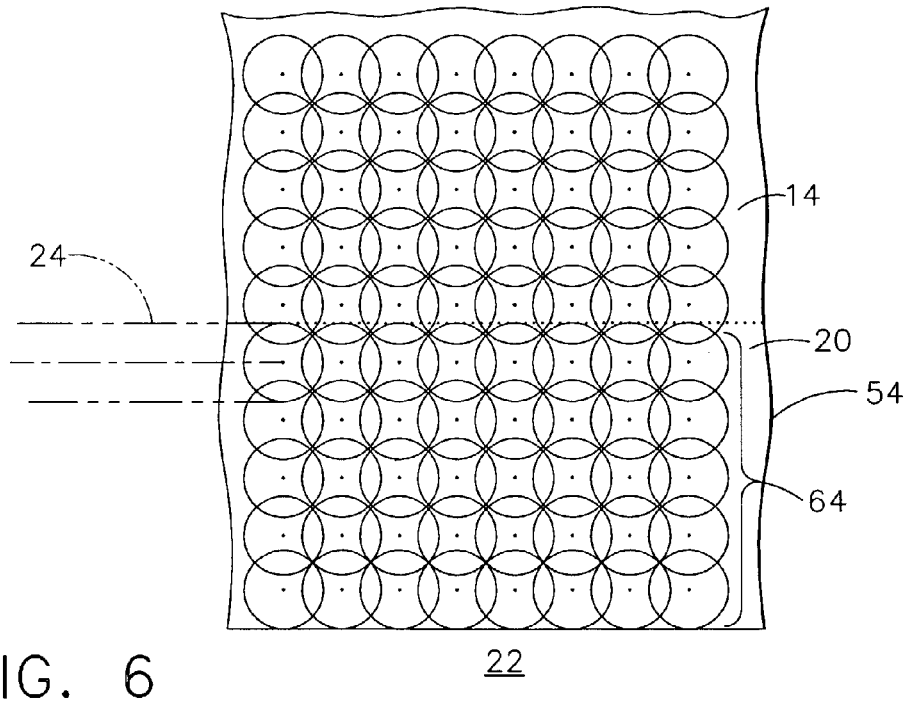
FIG. 6 is a diagrammatic illustration of a laser shock peening method using rows of progressively lower fluence laser shock peened spots for a feathered effect in the border area illustrated in FIG. 3.

FIG. 6 illustrates feathering the border area 20 by laser shock peening the border area 20 with progressively lower fluence laser beams indicated by progressively lower fluence laser shock peened spots 64 starting with the one first fluence laser beam 24 wherein the progressively lower fluence laser beams are in order of greatest fluence to least fluence in a direction outwardly from the first area through the border area 20 to the non-laser shock peened area 22. Feathering can be done with three or four or more rows of low fluence laser beams. One exemplary feathering method includes feathering from 200 J/cm$^2$ for the high fluence laser beam down to 50 J/cm$^2$ in −50 J/cm$^2$ increments, thus, having three rows of low fluence laser shock peened spots produced with 150 J/cm$^2$, 100 J/cm$^2$, and 50 J/cm$^2$ fluence laser beams, respectively. Another exemplary feathering method includes feathering from 200 J/cm$^2$ for the high fluence laser beam down to 25 J/cm$^2$ in −20 J/cm$^2$ increments, thus, having seven rows of low fluence laser shock peened spots produced with 175 J/cm$^2$, 150 J/cm$^2$, 125 J/cm$^2$, 100 J/cm$^2$, 75 J/cm$^2$, 50 J/cm$^2$, and 25 J/cm$^2$ fluence laser beams, respectively.

Figure 7:
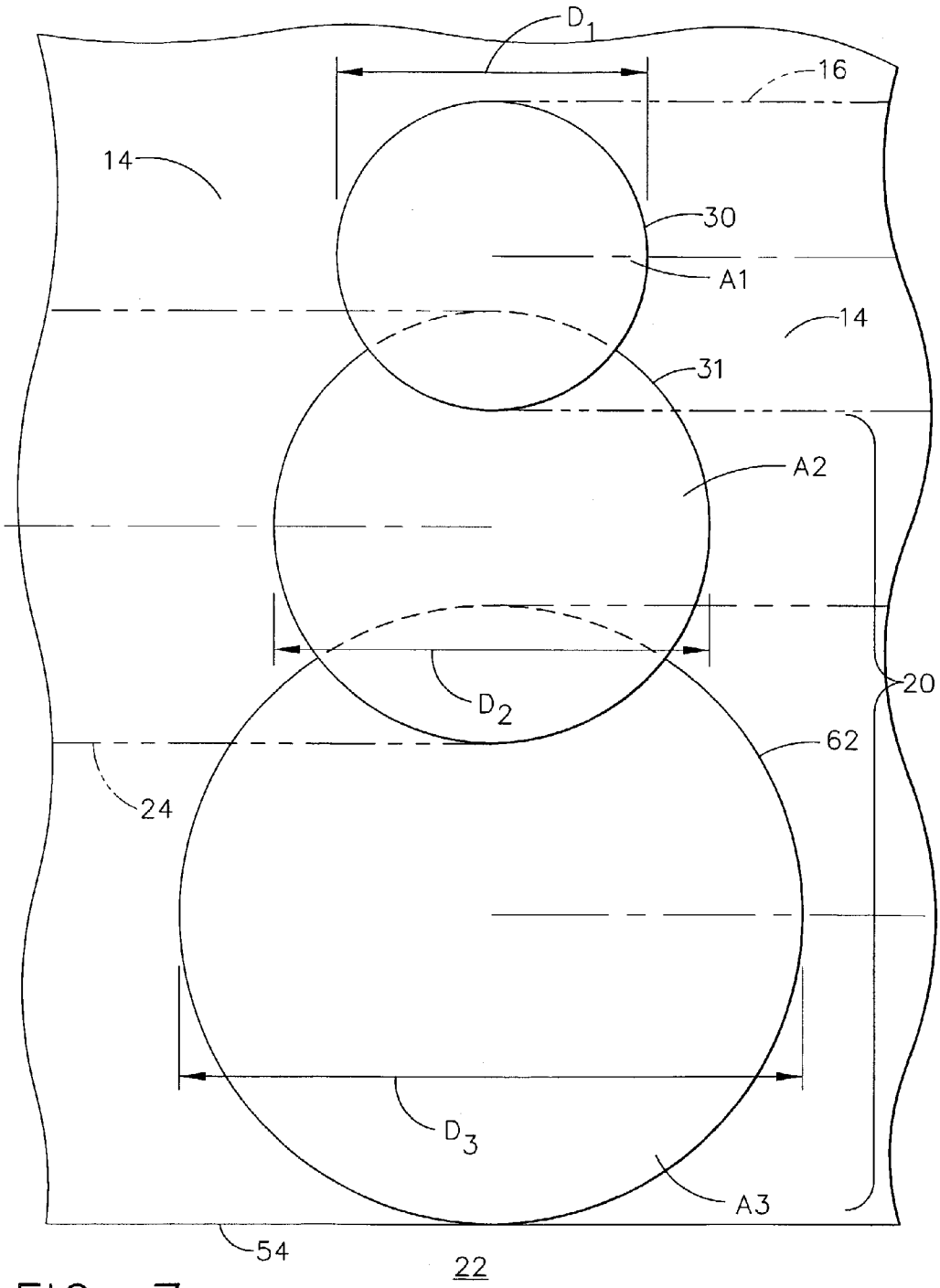
FIG. 7 is a diagrammatic illustration of a series of progressively larger laser shock peened spots made with same energy level laser beam to produce the progressively lower fluence laser shock peened spots that may be used in laser shock peening methods illustrated in FIGS. 3–6.

FIG. 7 illustrates laser shock peening the first area 14 with the high fluence laser beam 16 forming the high fluence laser shock peened spots 30, laser shock peening the border area 20 with the first low fluence laser beam 24 forming the second low fluence laser shock peened spots 31, and operating the high and low fluence laser beams 16 and 24 at the same power or energy level. This is indicated by second low fluence laser shock peened spots having a second area A2 and a second diameter D2 that are larger than a first area A1 and a first diameter D1, respectively, of the high fluence laser shock peened spots. If a second low fluence laser beam is used to form a row of third low fluence laser shock peened spots 62, then in order to use the same energy level, the third low fluence laser shock peened spots 62 would have a third area A3 and a third diameter D3 larger than the second area A2 and the second diameter D2, respectively, of the second low fluence laser shock peened spots. This method of using a laser beams with equal energy levels can be used for more than three rows of laser shock peened spots and for feathering as described above. Another embodiment of the method employs a variable attenuator for the laser which can be set to absorb or reflect 10%, 20%, . . . 75% of the laser output energy away from the target thus allowing laser beams with different fluences to be used with the same power laser.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A method for laser shock peening an article, said method comprising:

laser shock peening a first area with at least one high fluence laser beam, laser shock peening a border area between the first area and a non-laser shock peened area of the article with at least one first low fluence laser beam, forming high fluence laser shock peened spots in the first area with the high fluence laser beam, forming first low fluence laser shock peened spots in the border area with the low fluence laser beams, and operating the high and low fluence laser beams at the same power wherein the first low fluence laser shock peened spots are larger in area than the high fluence laser shock peened spots.

2. A method as claimed in claim 1, wherein the first low fluence laser beam has a fluence of about 50% of the high fluence laser beam.

3. A method as claimed in claim 2, wherein the high fluence laser beam has a fluence of about 200J/cm$^{2.}$

4. A method as claimed in claim 1, wherein the first law fluence laser beam is used to produce only a single row of first low fluence laser shock peened spots in the border area.

5. A method as claimed in claim 4, wherein the high fluence laser beam has a fluence of about 200J/cm$^{2.}$

6. A method as claimed in claim 1, further comprising laser shock peening a first portion of the border area bordering the first area with the first low fluence laser beam laser, laser shock peening a second portion of the border area between the first area and the non-laser shock peened area with a second low fluence laser beam wherein the second low fluence laser beam has a lower fluence than the first low fluence laser beam.

7. A method as claimed in claim 6, wherein the first low fluence laser beam has a fluence of about 50% of the high fluence laser beam.

8. A method as claimed in claim 7, wherein the second low fluence laser beam has a fluence of about 50% of the first low fluence laser beam.

9. A method as claimed in claim 6, wherein the high fluence laser beam has a fluence of about 200J/cm$^{2.}$

10. A method as claimed in claim 9, wherein the first low fluence laser beam has a fluence of about 50% of the high fluence laser beam.

11. A method as claimed in claim 10, wherein the second low fluence laser beam has a fluence of about 50% of the first low fluence laser beam.

12. A method as claimed in claim 1, further comprising laser shock peening the border area with progressively lower fluence laser beams starting with the one first fluence laser beam wherein the progressively lower fluence laser beams are in order of greatest fluence to least fluence in a direction outwardly from the first area through the border area to the non-laser shock peened area.

* * * * *